US010213032B1

(12) United States Patent
Fontaine-Cole

(10) Patent No.: US 10,213,032 B1
(45) Date of Patent: Feb. 26, 2019

(54) SOUND GENERATING BEVERAGE CONTAINER

(71) Applicant: Renee Fontaine-Cole, Lake Wales, FL (US)

(72) Inventor: Renee Fontaine-Cole, Lake Wales, FL (US)

( * ) Notice: Subject to any disclaimer, the term of this patent is extended or adjusted under 35 U.S.C. 154(b) by 0 days.

(21) Appl. No.: 15/477,361

(22) Filed: Apr. 3, 2017

Related U.S. Application Data

(60) Provisional application No. 62/316,682, filed on Apr. 1, 2016.

(51) Int. Cl.

| | |
|---|---|
| ***A47G 19/22*** | (2006.01) |
| ***B65D 43/02*** | (2006.01) |
| ***H04R 1/02*** | (2006.01) |
| ***F21L 4/00*** | (2006.01) |
| ***B65D 25/54*** | (2006.01) |
| ***B65D 25/28*** | (2006.01) |
| ***F21V 23/04*** | (2006.01) |
| *F21Y 115/10* | (2016.01) |
| *F21Y 103/10* | (2016.01) |

(52) U.S. Cl.
CPC ..... *A47G 19/2227* (2013.01); *A47G 19/2272* (2013.01); *A47G 19/2288* (2013.01); *B65D 25/2885* (2013.01); *B65D 25/54* (2013.01); *B65D 43/02* (2013.01); *F21L 4/00* (2013.01); *F21V 23/0414* (2013.01); *H04R 1/028* (2013.01); *A47G 2019/2238* (2013.01); *A47G 2019/2244* (2013.01); *B65D 2543/00046* (2013.01); *F21Y 2103/10* (2016.08); *F21Y 2115/10* (2016.08)

(58) Field of Classification Search
CPC ..... A47G 19/2227; A47G 2019/2211; A47G 19/2272; A47G 19/2288; H04R 1/028; H04R 3/00; B65D 25/2885; B65D 25/54; B65D 43/02
USPC ..... 206/217, 522
See application file for complete search history.

(56) References Cited

U.S. PATENT DOCUMENTS

| | | | | |
|---|---|---|---|---|
| 5,070,539 | A * | 12/1991 | Cheng | A47G 19/2227 220/737 |
| 5,105,940 | A * | 4/1992 | Chen | A47G 19/2227 206/217 |
| D336,825 | S | 6/1993 | Ivey | |
| 5,464,092 | A | 11/1995 | Seeley | |
| 5,536,196 | A | 7/1996 | Sternberg | |
| 5,739,758 | A * | 4/1998 | Driska | A47G 19/2227 215/235 |
| 5,969,592 | A | 10/1999 | Reed | |
| 6,140,932 | A * | 10/2000 | Frank | A47G 19/2227 206/217 |

(Continued)

FOREIGN PATENT DOCUMENTS

| | | |
|---|---|---|
| CN | 205018720 U | 2/2016 |

*Primary Examiner* — Chun Cheung
(74) *Attorney, Agent, or Firm* — Cramer Patent & Design; Aaron R. Cramer

(57) ABSTRACT

An insulated beverage container has a handle that extends from a side surface of the container and houses a battery, electrical connections, a luminescent strip and a speaker. An outside surface of the handle is provided with a control switch to activate the electrical components. The container is provided with an attachable lid. A user activates the switch to produce sounds from the speaker.

20 Claims, 3 Drawing Sheets

(56) References Cited

U.S. PATENT DOCUMENTS

| | | | | |
|---|---|---|---|---|
| 6,325,693 | B1 | 12/2001 | Rudell et al. | |
| 6,443,589 | B1 * | 9/2002 | Lee | A47G 19/2227 362/101 |
| D493,071 | S | 7/2004 | Fasula et al. | |
| 6,778,813 | B1 | 8/2004 | Lilly | |
| 6,793,362 | B2 | 9/2004 | Tai | |
| 8,344,902 | B2 * | 1/2013 | Chen | A47G 19/2227 340/384.73 |
| 8,550,288 | B2 * | 10/2013 | Briar | B65D 25/02 137/386 |
| 9,560,431 | B1 | 1/2017 | Lilly | |
| 2001/0041945 | A1 * | 11/2001 | Lo | A47G 19/2227 700/94 |
| 2002/0126851 | A1 * | 9/2002 | Lo | A47G 19/2227 381/61 |
| 2002/0185388 | A1 * | 12/2002 | Su | A47G 19/2227 206/217 |
| 2003/0076671 | A1 | 4/2003 | Diak/Ghanem | |
| 2006/0207410 | A1 | 9/2006 | Kim et al. | |
| 2006/0261233 | A1 * | 11/2006 | Williams | A47G 19/2227 248/311.2 |
| 2009/0114554 | A1 | 5/2009 | Earnest | |
| 2014/0174964 | A1 | 6/2014 | White et al. | |

* cited by examiner

SOUND GENERATING BEVERAGE CONTAINER

RELATED APPLICATIONS

This application is a Continuation and claims the benefit of U.S. Provisional Application No. 62/316,682 which was filed Apr. 1, 2016, the entire disclosures of which are incorporated herein by reference.

FIELD OF THE INVENTION

The present invention relates generally to the field of drinking cups and more specifically relates to a drinking cup system.

BACKGROUND OF THE INVENTION

Travel mugs generally employ thermal insulation properties for transporting hot or cold liquids. Like a vacuum flask, a travel mug is usually well-insulated and completely enclosed to prevent spillage or leaking, but will generally have an opening in the cover through which the contents can be consumed during transportation without spillage. Usually stainless steel will be used for the inner wall while outer wall can be stainless steel, plastic, or even embedded with other materials.

Mugs designed for usage when driving are often called auto mugs or commuter mugs, as they enable users to enjoy a beverage while driving. Travel mugs have a spill-proof lid with a sipping opening and in many cases, a narrower base, so that they will fit into the cup-holders that are built into many vehicles. Travel mugs may be designed to be used without obstructing a driver's view of the road when he or she is drinking, and able to fit, stably, into a wide range of mug or cup holders. Generally, most cups and/or mugs serve the specific purpose for providing a vessel to contain a beverage, as consumers often enjoy novelty devices which may include sights and sounds. Therefore, a suitable solution is desired.

Various attempts have been made to solve problems found in drinking cup art. Among these are found in: U.S. Pat. No. 4,765,465 to Yamada; U.S. Pat. No. 5,119,279 to Makowsky; and U.S. Pat. No. 5,211,699 to Tipton. These prior art references are representative of drinking cups.

None of the above inventions and patents, taken either singly or in combination, is seen to describe the invention as claimed. Thus, a need exists for a reliable drinking cup system, and to avoid the above-mentioned problems.

SUMMARY OF THE INVENTION

The principles of the present invention provide for a beverage vessel comprising a vessel body, a liner a handle having a handle first end secured to the vessel body exterior wall adjacent the top of the vessel and a handle second end, a power source residing within an interior void of the handle, an audio source residing within the second interstitial space, an illumination means disposed about the vessel body exterior wall for illuminating a general vicinity of the beverage vessel and a switch, providing electrical communication between the power source, the audio source, and the illuminating means.

The vessel body comprises a vessel interior, a vessel body wall having a vessel body wall exterior side and a vessel body wall interior side, an opening disposed within a vessel body first end in environmental communication with the vessel interior, a bottom at a vessel body second end opposite the opening, having a bottom exterior side and a bottom interior side and a first interstitial space between the vessel body wall exterior side and the vessel body wall interior side and between the bottom exterior side and the bottom interior side.

The liner comprises a liner interior, a liner wall having a liner wall exterior side and a liner wall interior side and a liner bottom having a liner bottom exterior side and a liner bottom interior side. The liner is capable of being removably placed within the vessel interior. When the liner is placed within the vessel interior the liner bottom exterior side is adjacent the vessel bottom interior side thereby defining a second interstitial space. Additionally, the liner is configured to retain a beverage. A separate embodiment of the device comprises a removable lid attached to an upper perimeter of the vessel body. The lid may also comprise a spill-proof liquid access mechanism.

The illumination means is secured beneath a translucent cover. The illuminating means may be a luminescent strip continuously disposed about a circumference of the vessel body exterior wall, a plurality of lamps which are continuously disposed about a circumference of the vessel body exterior wall or a light string continuously likewise disposed about a circumference of the vessel body exterior wall.

The power source may comprise a battery which is accessed by a battery compartment door disposed within the handle second end. The audio source may comprise a speaker, an amplifier in electrical communication with the speaker and a sound producing circuit which is in electrical communication with the speaker and the amplifier. A plurality of apertures may comprise a speaker grill that is disposed within the vessel body wall exterior side and adjacent the bottom exterior side. The switch may be disposed upon the handle.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
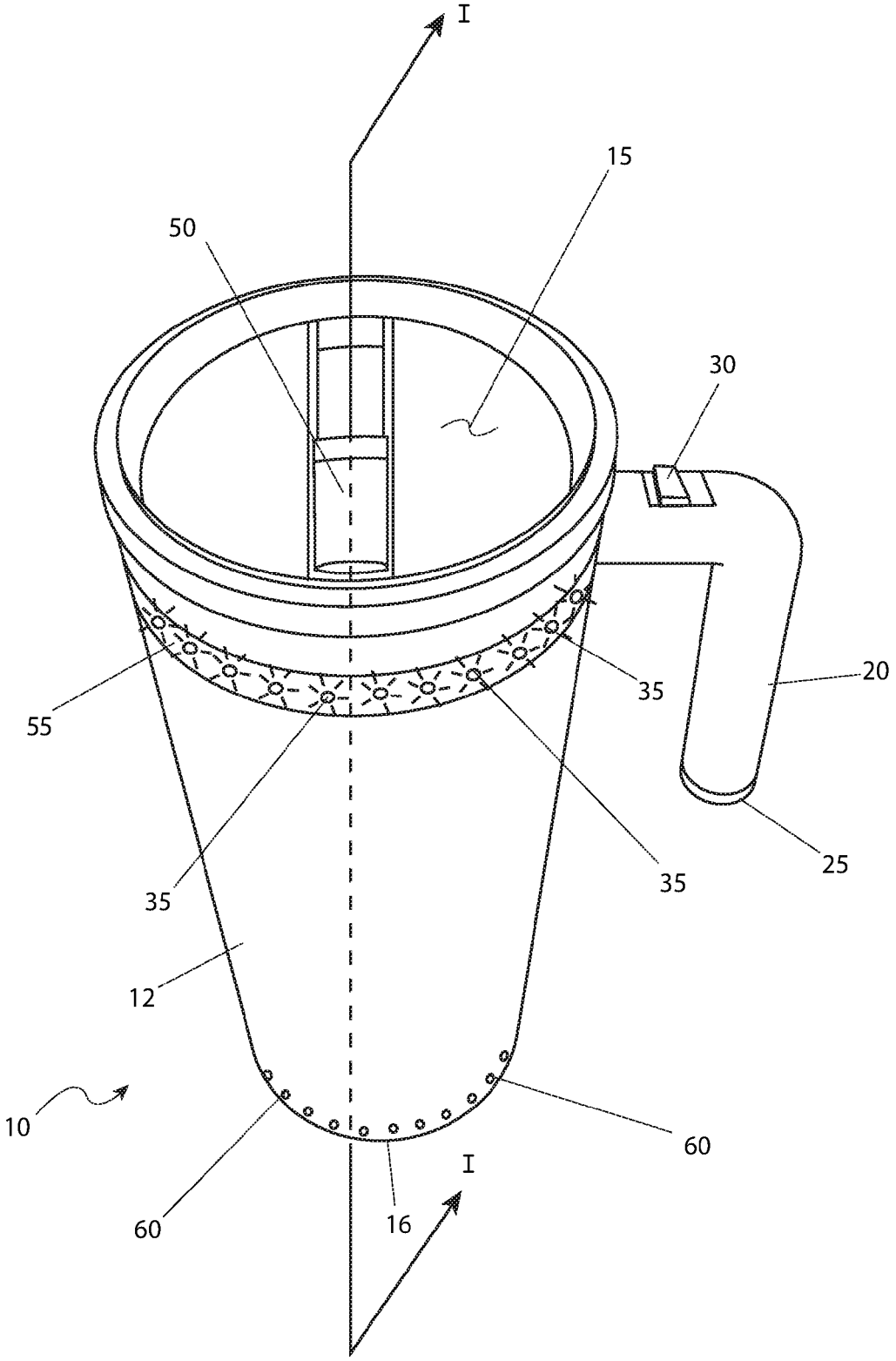
FIG. 1 is a perspective view of an insulated beverage cup with audio/visual enhancements 10 according to an embodiment of the present invention.

10 insulated beverage cup with audio/visual enhancements
12 sidewall
15 lid
16 bottom wall
20 handle
25 battery compartment door
30 switch
35 luminescent strip
50 spill-proof liquid access mechanism

55 translucent cover material
60 speaker grill
65 speaker
70 sound waves
75 amplifier
80 sound producing circuit
85 interstitial space
90 removable liner
95 battery
100 blocking diode
105 LED driver circuit

DETAILED DESCRIPTION OF THE PREFERRED EMBODIMENT

The present invention is directed to a beverage vessel 10. In one (1) embodiment of the present invention, the vessel 10 may comprise a removable lid 15, a luminescent strip 35, a speaker 65, an amplifier 75, sound producing circuit 80, a switch 30, a battery 95, and a handle 20.

Referring now to the drawings, there is shown in FIG. 1 an insulated beverage cup with audio/visual enhancements 10, herein after referred to as a vessel 10, designed for containing various hot and cold beverages when at home or on the go, comprising a bottom wall 16, a sidewall 12, a top opening, and an interior in fluid communication with the top opening. The vessel 10 may be insulated, or double insulated intended for keeping beverages hot and/or cold as well as the user's hands comfortable. The vessel 10 may be constructed of stainless steel, plastic or other suitable materials. The aforementioned suitable materials may allow a user to easily wash and keep beverages hot and/or cold for extended periods of time. The vessel 10 may further comprise a handle 20 having a switch 30 in the form of a slide switch located thereon for controlling and operating the luminescent strip 35 and audio output. The handle 20 is able to house a power source within a compartment accessible by a door 25. The vessel 10, is provided with a spill-proof liquid access mechanism 50, such as slide plate, pressure gasket, or the like, which is designed to be easy to open by the hand holding the vessel 10, such as by using an index finger, or the like, in an effort to prevent distractions while driving or on the go. The spill-proof liquid access mechanism 50 is attached to a spill-proof lid 15 attached to the upper perimeter of the sidewall 12 adjacent the top opening. The spill proof lid 15 is removably attached via friction fit for purposes of filling, emptying, and cleaning of the vessel 10. The spill-proof lid 15 is designed to keep liquids from spilling out when using the vessel 10. The spill-proof lid 15 is also helpful for keeping maintain hot or cold temperatures inside the vessel 10 relative to ambient outside temperatures.

Unlike regular mugs, the vessel 10 may be designed to fit easily within vehicle cup holders, with an angled sidewall 12 tapering from the top opening to a flat bottom wall 16. The sidewall 12 of the vessel 10 is preferably approximately six inches (6 in.) tall. The bottom wall 16 of the vessel 10 is approximately two-and-a-half inches (2½ in.) wide. Similarly, the middle of vessel 10 may be approximately three inches (3 in.) wide. The top opening of the vessel 10 may be approximately three-and-a-half inches (3½ in.) wide. Subjacent from the bottommost extension of the lid 15 as it is fastened to the vessel 10, is a continuous circumferential luminescent strip 35, preferably comprising at least one (1) LED lamp or a LED lamp string in electrical communication with the power source and controlled by the switch 30. The luminescent strip 35 is capable of illuminating the general vicinity of the vessel 10. A translucent cover material 55 envisioned to be manufactured of plastic provides environmental protection for the luminescent strip 35. A speaker grill 60 is provided near the lower extreme of the sidewall 12 to allow for reproduction of audio such as music, speech, sound effects or the like. Reproduction of audio is controlled by the switch 30. Further description of the audio reproduction functionality of the vessel 10 will be provided herein below.

Figure 2:
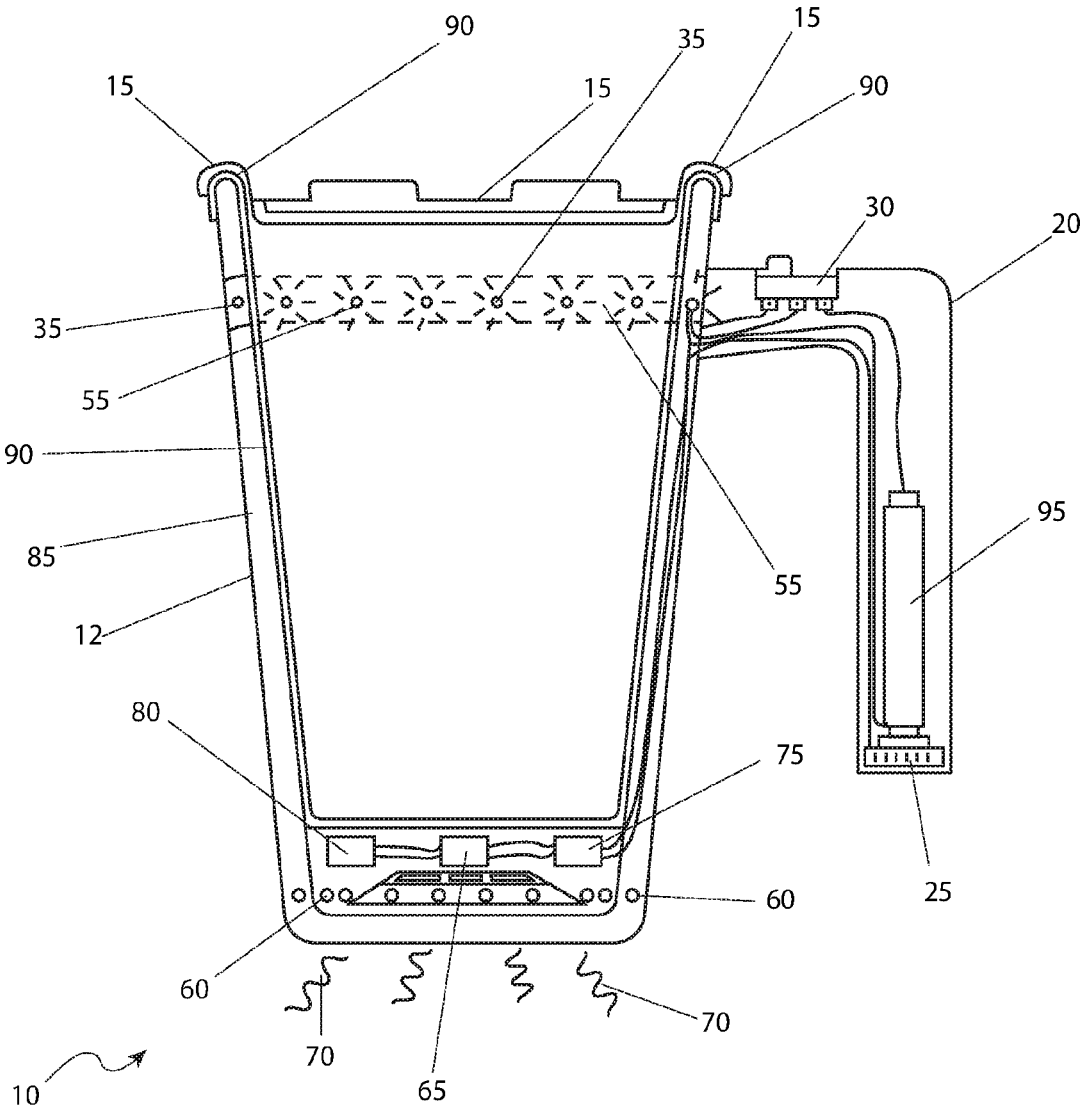
FIG. 2 is a sectional view of the insulated beverage cup with audio/visual enhancements 10, as seen along a line I-I, as shown in FIG. 1, according to an embodiment of the present invention; and, FIG. 3 is a functional block diagram depicting the major electronic components of the insulated beverage cup with audio/visual enhancements 10, according to an embodiment of the present invention.

Referring next to FIG. 2, a sectional view of the insulated beverage cup with audio/visual enhancements 10, as seen along a line I-I, as shown in FIG. 1, according to an embodiment of the present invention is depicted. A speaker 65 is located near the lower extremes of the vessel 10 and provides for the reproduction of sound waves 70 through the speaker grill 60. The speaker 65 is electrically connected to an amplifier 75 and a sound producing circuit 80. The sound producing circuit 80 is envisioned to a sound chip with prerecorded audio files, a removable memory chip with multiple pre-recorded files, a Bluetooth® interface, or the like. The use of any particular type or method of sound producing circuit is not intended to be a limiting factor of the present invention. The sidewall 12 provides a sectional interface comprising an interstitial space 85 for purposes of routing wiring and the like. The vessel 10 provides a removable liner 90 which slides in and out of the interior. The vessel 10 is envisioned to be held in place via friction fit, a threaded engagement or similar capturing method. Said removable function allows the removable liner 90 and the lid 15 to be washed, cleaned, rinsed, or the like without exposing the remaining components of the vessel 10 to damage due to water exposure. A battery 95 is contained under the battery compartment door 25 and is electrical communication with the switch 30. Output of the switch is used to drive the luminescent strip 35, the amplifier 75, and the sound producing circuit 80.

Figure 3:
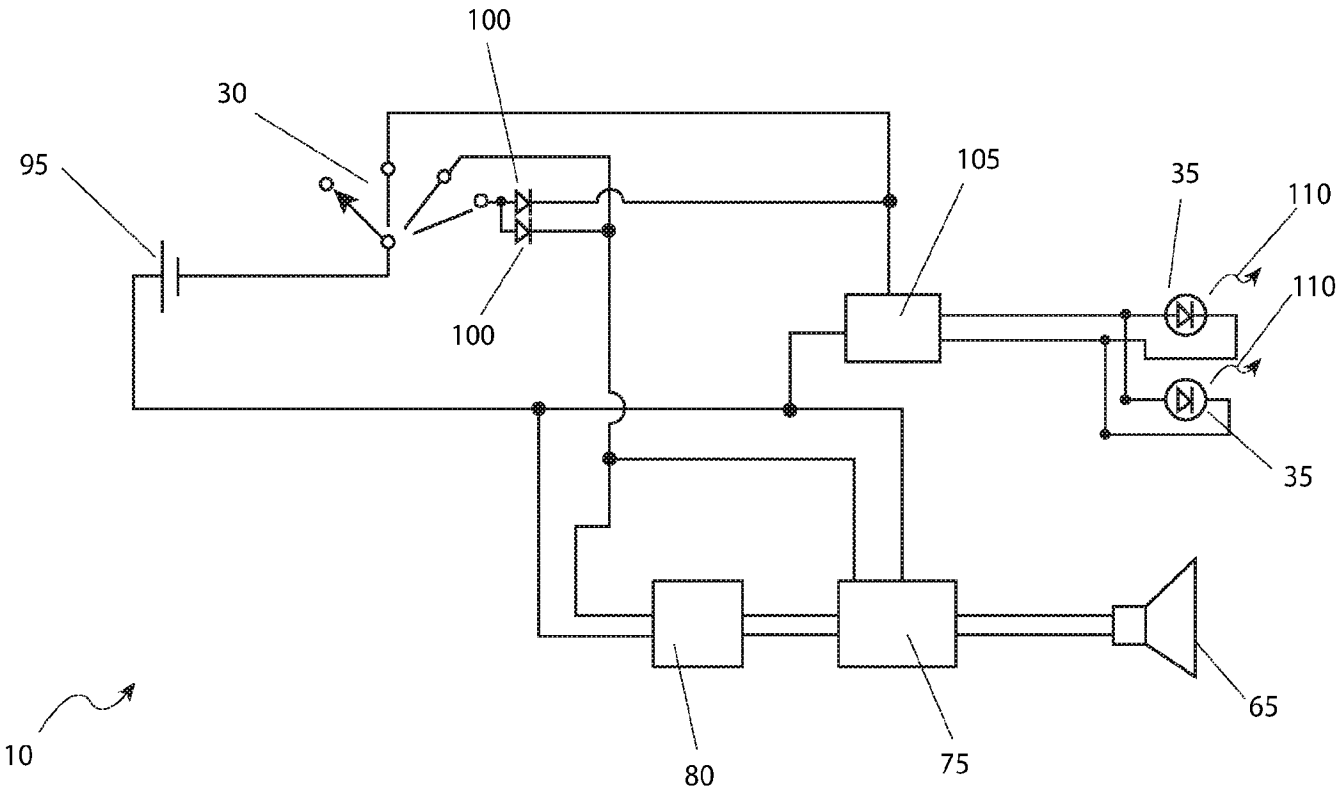

Referring finally to FIG. 3, a functional block diagram depicting the major electronic components of the insulated beverage cup with audio/visual enhancements 10, according to an embodiment of the present invention is disclosed. Power from the battery 95, envisioned to be an AA battery of the disposable or rechargeable variety is housed within the battery compartment door 25 held in place via a threaded connection. Output power from the battery 95 is routed to the switch 30, here depicted as a 3-pole, 4-position switch. The four (4) positions are envisioned as OFF, VISUAL (luminescent strip 35), AUDIO (speaker 65), and BOTH VISUAL AND AUDIO. A set of blocking diodes 100 prevent unintended operation of the opposing circuit while the switch 30 is in the VISUAL or AUDIO position. Output of the switch 30 is then routed to a LED driver circuit 105 to provide proper voltage and current characteristics to the luminescent strip 35, herein depicted as individual LED lamps emitting light waves 110 (only two (2) of which as shown due to illustrative limitations). Additionally, the switch provides power to the amplifier 75 and the sound producing circuit 80 in a parallel wiring circuit. An amplified waveform is then passed to the speaker 65.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A beverage vessel, comprising:

a vessel body comprising:

a vessel interior;

a vessel body wall having a vessel body wall exterior side and a vessel body wall interior side;

an opening disposed within a vessel body first end in environmental communication with said vessel interior;

a bottom at a vessel body second end opposite said opening, having a bottom exterior side and a bottom interior side; and, a first interstitial space between said vessel body wall exterior side and said vessel body wall interior side and between said bottom exterior side and said bottom interior side;

a liner comprising:

a liner interior;

a liner wall having a liner wall exterior side and a liner wall interior side; and, a liner bottom having a liner bottom exterior side and a liner bottom interior side;

wherein said liner is capable of being removably placed within said vessel interior;

wherein when said liner is placed within said vessel interior said liner bottom exterior side is adjacent said vessel bottom interior side thereby defining a second interstitial space; and, wherein said liner is configured to retain a beverage therein;

a handle having a handle first end secured to said vessel body exterior wall adjacent said opening and a handle second end;

a power source residing within an interior void of said handle;

an audio source residing within said second interstitial space;

an illumination means disposed about said vessel body exterior wall for illuminating a general vicinity of said beverage vessel; and, a switch, providing electrical communication between said power source, said audio source, and said illuminating means.

2. The vessel of claim 1, wherein said illumination means is secured beneath a translucent cover.

3. The vessel of claim 2, wherein said illuminating means is a luminescent strip continuously disposed about a circumference of said vessel body exterior wall.

4. The vessel of claim 2, wherein said illuminating means is a plurality of lamps continuously disposed about a circumference of said vessel body exterior wall.

5. The vessel of claim 2, wherein said illuminating means is a light string continuously disposed about a circumference of said vessel body exterior wall.

6. The vessel of claim 1, wherein said power source comprises a battery accessed by a battery compartment door disposed within said handle second end.

7. The vessel of claim 1, wherein said audio source comprises:

a speaker;

an amplifier in electrical communication with said speaker; and, a sound producing circuit in electrical communication with said speaker and said amplifier.

8. The vessel of claim 7, wherein a plurality of apertures comprising a speaker grill is disposed within said vessel body wall exterior side and adjacent said bottom exterior side.

9. The vessel of claim 1, wherein said switch is disposed upon said handle.

10. The vessel of claim 1, further comprising a lid, removably attached to an upper perimeter of said opening.

11. A beverage vessel, comprising:

a vessel body comprising:

a vessel interior;

a vessel body wall having a vessel body wall exterior side and a vessel body wall interior side;

an opening disposed within a vessel body first end in environmental communication with said vessel interior;

a bottom at a vessel body second end opposite said opening, having a bottom exterior side and a bottom interior side; and, a first interstitial space between said vessel body wall exterior side and said vessel body wall interior side and between said bottom exterior side and said bottom interior side;

a liner comprising:

a liner interior;

a liner wall having a liner wall exterior side and a liner wall interior side; and, a liner bottom having a liner bottom exterior side and a liner bottom interior side;

wherein said liner is capable of being removably placed within said vessel interior;

wherein when said liner is placed within said vessel interior said liner bottom exterior side is adjacent said vessel bottom interior side thereby defining a second interstitial space; and, wherein said liner is configured to retain a beverage therein;

a lid, removably attached to an upper perimeter of said opening;

a handle having a handle first end secured to said vessel body exterior wall adjacent said opening and a handle second end;

a power source residing within an interior void of said handle;

an audio source residing within said second interstitial space;

an illumination means disposed about said vessel body exterior wall for illuminating a general vicinity of said beverage vessel; and, a switch, providing electrical communication between said power source, said audio source, and said illuminating means.

12. The vessel of claim 11, wherein said illumination means is secured beneath a translucent cover.

13. The vessel of claim 12, wherein said illuminating means is a luminescent strip continuously disposed about a circumference of said vessel body exterior wall.

14. The vessel of claim 12, wherein said illuminating means is a plurality of lamps continuously disposed about a circumference of said vessel body exterior wall.

15. The vessel of claim 12, wherein said illuminating means is a light string continuously disposed about a circumference of said vessel body exterior wall.

16. The vessel of claim 11, wherein said power source comprises a battery accessed by a battery compartment door disposed within said handle second end.

17. The vessel of claim 11, wherein said audio source comprises:

a speaker;

an amplifier in electrical communication with said speaker; and, a sound producing circuit in electrical communication with said speaker and said amplifier.

18. The vessel of claim 17, wherein a plurality of apertures comprising a speaker grill is disposed within said vessel body wall exterior side and adjacent said bottom exterior side.

19. The vessel of claim 11, wherein said switch is disposed upon said handle.

20. The vessel of claim 11, wherein said lid further comprises a spill-proof liquid access mechanism.

* * * * *